US006802762B2

(12) United States Patent
Tanaka et al.

(10) Patent No.: US 6,802,762 B2
(45) Date of Patent: Oct. 12, 2004

(54) METHOD FOR SUPPLYING SLURRY TO POLISHING APPARATUS

(75) Inventors: Takashi Tanaka, Kanagawa (JP); Takashi Tsuzuki, Tokyo (JP); Fujihiko Toyomasu, Kanagawa (JP)

(73) Assignee: Ebara Corporation, Tokyo (JP)

( * ) Notice: Subject to any disclaimer, the term of this patent is extended or adjusted under 35 U.S.C. 154(b) by 134 days.

(21) Appl. No.: 09/970,621

(22) Filed: Oct. 5, 2001

(65) Prior Publication Data

US 2002/0045412 A1 Apr. 18, 2002

(30) Foreign Application Priority Data

Oct. 6, 2000 (JP) ..... 2000/307224
Dec. 5, 2000 (JP) ..... 2000/370600

(51) Int. Cl.[7] ..... B24B 57/02; B24B 7/22

(52) U.S. Cl. ..... 451/60; 451/56; 451/28; 451/41

(58) Field of Search ..... 451/60, 41, 28, 451/285–289, 446, 56; 125/16.01, 16.02, 21

(56) References Cited

U.S. PATENT DOCUMENTS 5,799,643 A * 9/1998 Miyata et al. ..... 125/21
6,161,533 A * 12/2000 Katsumata et al. ..... 125/21
6,406,364 B1 * 6/2002 Kimura et al. ..... 451/446
6,475,070 B1 * 11/2002 White ..... 451/59
2002/0045412 A1 * 4/2002 Tanaka et al. ..... 451/60
2002/0173232 A1 * 11/2002 Laursen ..... 451/8

* cited by examiner

*Primary Examiner*—Lee D. Wilson
(74) *Attorney, Agent, or Firm*—Wenderoth, Lind & Ponack, L.L.P.

(57) ABSTRACT

A method for feeding slurry, and a slurry feeder capable of feeding slurry to a chemical mechanical polishing apparatus, are disclosed. Slurry is fed from a slurry supply tank, that stores slurry at a given concentration, to chemical mechanical polishing apparatuses via slurry feed pumps. Operations of the slurry feed pumps are suspended during a period of time other than during a time of feeding slurry to the chemical mechanical polishing apparatuses. A slurry feeder for feeding a slurry to a polishing apparatus includes a pump for feeding slurry at a flow rate Q from a slurry supply tank to the polishing apparatus. When a given sedimentation velocity of slurry is indicated by V, a horizontal sectional area of the slurry supply tank is set to become smaller than Q/V.

13 Claims, 7 Drawing Sheets

Fig. 10

| CASE NO. | CASE 1 | CASE 2 | CASE 3 |
|---|---|---|---|
| INITIAL CONCENTRATION OF SLURRY | 4.7 wt% | 4.7% wt% | 4.5% wt% |
| CONCENTRATION DIFFERENCE (INITIAL CONCENTRATION +/- DEVIATION) | LESS THAN +/-4% | LESS THAN +/-4% | LESS THAN +/-32% |
| FLOW VELOCITY INSIDE SUPPLY TANK | 0.00531 m/s | 0.00265 m/s | 0.00074 m/s |
| FLOW VELOCITY INSIDE PIPE | 0.842 m/s | 0.421 m/s | 0.118 m/s |
| SECTIONAL AREA OF SUPPLY TANK | 31,400 $mm^2$ | 31,400 $mm^2$ | 31,400 $mm^2$ |
| TANK DIAMETER | 200 mm | 200 mm | 200 mm |
| CIRCULATING FLOW RATE | 10 L/min | 5 L/min | 1.4 L/min |
| PIPE DIAMETER | 15.88 mm | 15.88 mm | 15.88 mm |
| PROPERTY OF SLURRY | SETTLING SLURRY (CERIA, ALUMINA TYPE) | SETTLING SLURRY (CERIA, ALUMINA TYPE) | SETTLING SLURRY (CERIA, ALUMINA TYPE) |

METHOD FOR SUPPLYING SLURRY TO POLISHING APPARATUS

BACKGROUND OF THE INVENTION

The present invention relates to a method for supplying a slurry, particularly a slurry having an agglomerating property, and a slurry feeder suitable for use with a polishing apparatus for chemical mechanical polishing an object.

The present invention also relates to a slurry feeder for feeding a slurry (polishing fluid) to a main body of a polishing apparatus for polishing a surface of an object such as a semiconductor wafer to an even surface and a mirror-finished surface, a polishing apparatus having the main body and the slurry feeder, and a method for operation of the slurry feeder.

Hitherto, circuit wiring has become finer and distance between wires has become narrower as the integration of semiconductor devices develops. In particular, in a case of photolithography having a line width of at most 5 microns, an allowable focal depth is so shallow that a high degree of evenness on an imaging plane of a stepper is required. Therefore, a surface of a semiconductor wafer has to be made even. One of method for flattening a surface of a semiconductor wafer involves polishing the surface of the wafer with a chemical mechanical polishing apparatus.

FIG. 8 illustrates an example of an essential portion of a chemical mechanical polishing apparatus. This apparatus has a turntable 142 with a polishing cloth (a polishing tool) 140 attached on top thereof, a top ring 144 for rotatably pressing and holding a semiconductor wafer W as an object to be polished, and a slurry feed nozzle 146 for feeding slurry Q to the polishing cloth 140. The top ring 144 is connected to a top ring shaft 148 and held with an air cylinder (not shown) so as to be vertically movable. The top ring 144 has an elastic mat 150, e.g., a polyurethane mat, attached closely to bottom surface thereof, to hold the semiconductor wafer W. The top ring 144 also has a cylinder-shaped guide ring 152 disposed at an outer edge portion thereof in order to prevent the top ring 144 from dropping during polishing operations. The guide ring 152 is fixed to the top ring 144, and a bottom end surface of the guide ring 152 protrudes from a holding surface of the top ring 144 and is provided with a depressed portion inside a bottom end thereof for holding the semiconductor wafer W.

With this arrangement of the chemical mechanical polishing apparatus, the semiconductor wafer W is held under the elastic mat 150 below the top ring 144. The semiconductor wafer W is pressed against the polishing cloth 140 on the turntable 142 by the top ring 144, and is polished while rotating the turntable 142 and the top ring 144 and moving the semiconductor wafer W relatively to the polishing cloth 140. The slurry Q is supplied to the polishing cloth 140 from the slurry feed nozzle 146 during polishing operations.

In order to allow a good polishing of the semiconductor wafer W with the chemical mechanical polishing apparatus, a slurry feeder is required which can stably provide the chemical mechanical polishing apparatus with slurry (polishing or grinding fluid) at a constant concentration and a flow rate. The slurry feeder generally includes, for example, a stock solution tank for storing a stock solution of slurry, a preparation tank for adjusting concentration of slurry by diluting the stock solution with a deionized water (pure water), a chemical liquid or the like to a given concentration, a slurry supply tank for temporarily storing slurry adjusted in the preparation tank, and a slurry feed pipe for feeding the slurry from the slurry supply tank to the slurry feed nozzle 146 of the chemical mechanical polishing apparatus.

A conventional slurry feed pipe connecting the slurry supply tank to the chemical mechanical polishing apparatus adopts a so-called general circulation and supply system for discharging slurry via a roller pump from a circulating line to a table in the chemical mechanical polishing apparatus. This slurry feed pipe is provided with a circulating pipe for returning slurry discharged from the slurry supply tank back to the slurry supply tank, and a pipe branched from the circulating pipe for feeding the slurry to the chemical mechanical polishing apparatus. The slurry feed pipe is arranged so as to carry out the circulating operations for returning the slurry discharged from the slurry supply tank back to the slurry supply tank via circulating pump disposed in the circulating pipe, even if the chemical mechanical polishing apparatus is operated for polishing or is idling.

It is to be noted that slurry having an agglomerating property becomes more likely to agglomerate into particles having larger particle sizes, when the slurry is in a fluid state. Therefore, if such slurry is used for this invention, it may present a problem in that agglomeration of the slurry may be accelerated when the slurry is always in a fluid state due to circulating operations by virtue of the circulating pump in the manner as described above. In other words, the above feeding system cannot suspend circulation operations of the circulating pump. And thus the slurry has to be constantly circulated unless all chemical mechanical polishing apparatuses are brought into an idling status. Otherwise, agglomeration of the slurry would be accelerated.

In recent years, when manufacturing semiconductor devices, there is an increasing demand that plural device layers are formed on a semiconductor wafer. In order to accurately form plural device layers, it is necessary to make a surface of a layer covering each device layer flat and mirror-finished by utilizing a polishing apparatus. The polishing apparatus includes a main body having turntables, each rotating at an independent number of rotations, and also includes a top ring and a slurry feeder. Between a corresponding one of the turntables and the top ring is disposed an object such as a semiconductor wafer, and a surface of the object is polished to an even and mirror-finished surface by rotating this turntable while feeding a slurry for use during polishing.

The slurry feeder is required to supply a slurry (polishing fluid) continually to the polishing apparatus. In order to prevent interruption of supply of slurry during a process of polishing, a buffer tank is disposed which contains a slurry of a capacity that can polish at least one surface of a semiconductor wafer. The buffer tank is provided with a stirring device so as to stir the slurry well in order to prevent the slurry from remaining in the buffer tank and polishing particles from settling to make t concentration of the slurry irregular. The stirring device can stir the slurry in the buffer tank to keep a uniform concentration of the slurry to be fed to the polishing apparatus and enable polishing of the object at a high accuracy.

SUMMARY OF THE INVENTION

The present invention has been made with the above situation taken into account and an object of the present invention is to provide a method for supply of slurry, and a slurry feeder, which can provide a chemical mechanical polishing apparatus with slurry, including slurry with an agglomerating property, in an appropriate manner without causing the acceleration of agglomeration of the slurry.

Because such a conventional slurry feeder has a the buffer tank with a stirring device, however, an apparatus is rendered complex in structure and stirring causes a temperature of the slurry to rise so as to render a cooling load of the slurry high.

The present invention has been made with the above disadvantages taken into account and it has an object to provide a slurry feeder having a simplified structure capable of feeding a slurry having a uniform concentration, a polishing apparatus installed with the slurry feeder, and a method for operation of the slurry feeder.

In order to achieve the object as described above, the present invention provides a method for supply of slurry from a slurry supply tank, that stores slurry at a given concentration, to a chemical mechanical polishing apparatus for polishing an object, wherein operations of a slurry feed pump are suspended during a period of time other than during a time of the operations of feeding slurry to a chemical mechanical polishing apparatus.

The present invention also provides a method for feeding all slurry discharged from a slurry supply tank by virtue of a slurry feed pump to a chemical mechanical polishing apparatus while in operation.

The present invention is characterized in that a slurry feeder having a slurry supply tank for storing slurry at a given concentration, and a slurry feed pipe for feeding slurry from the slurry supply tank to a chemical mechanical polishing apparatus via a slurry feed pump, is provided with a control system for suspending operations of slurry feed pump for feeding slurry to the chemical mechanical polishing apparatus during a period of time other than during a time of feeding slurry to the chemical mechanical polishing apparatus in during a process of polishing.

The present invention is further characterized in that a plurality of turntables for use with a chemical mechanical polishing apparatus is disposed and that a supply pump is disposed for each of the turntables.

Moreover, the present invention is characterized in that a slurry feeder is provided with a preparation tank for adjusting a stock solution of slurry to a given concentration by mixing the stock solution thereof with deionized water or a chemical liquid, and for feeding the slurry of the given concentration to slurry supply tank. A control system is arranged so as to suspend circulating operations for returning slurry discharged from the preparation tank back to the preparation tank and so as to suspend stirring operations for stirring slurry in the preparation tank during a period of time other than during a time of adjusting concentration of slurry by diluting it in the preparation tank.

Additionally, the present invention is characterized in that a portion of a slurry supply tank connected to a slurry feed pipe is disposed so as to fail to discharge a slurry agglomerate, settled to a bottom portion of slurry supply tank, into slurry feed pipe by locating an exit for discharging slurry above the bottom of slurry supply tank.

In order to achieve the these objects, for example, as shown in FIG. 9, a slurry feeder according to the present invention comprises a slurry feeder 252 for feeding a given slurry to a polishing apparatus 251, and a slurry supply tank 212 for storing slurry to be fed to the polishing apparatus 251, wherein slurry is fed at a flow rate Q from slurry supply tank 212 to the polishing apparatus 251 and, when polishing particles in the g slurry is are allowed to settle at a sedimentation velocity V, a horizontal sectional area of slurry supply tank 212 is set to become smaller than Q/V. A configuration of feeding slurry at flow rate Q can be achieved typically by locating a pump for feeding slurry at the flow rate Q.

As the horizontal sectional area of slurry supply tank is formed so as to become smaller than Q/V, a vertical flow velocity of slurry in the slurry supply tank can be made greater than the sedimentation velocity of the polishing particles in slurry, and the slurry is allowed to be stirred well by flowing slurry in the storage tank and to sustain concentration of the slurry at a constant level. The slurry supply tank is configured such that, in usual cases, slurry enters from a vertical top portion thereof and it is discharged from a vertical bottom portion thereof. Sedimentation velocity of polishing particles in slurry means a velocity at which one polishing particle in slurry settles in a solution (typically deionized water) by virtue of gravity.

In order to achieve this object, the present invention provides a polishing apparatus, as shown in FIG. 9, which comprises a slurry feeder 252, a polishing table 242 slurry is provided from slurry feeder 252, and a slurry-returning line 308 through which slurry fed from slurry feeder 252 and not used for the polishing table 242 is returned to slurry supply tank 212.

With an arrangement of the polishing apparatus in the manner as described above, polishing can be effected by loading an object onto the polishing table and feeding slurry at a constant concentration from slurry feeder to the polishing apparatus, and slurry not used for the polishing table is returned to slurry supply tank for re-use by circulating this slurry. Because slurry in slurry supply tank is not stirred with a stirring device, a cooling load of slurry can be made small circulating the slurry. Further, concentration of slurry can be made constant when a returning flow velocity of slurry in a slurry-return line is set to be within a given scope in which concentration of slurry is made constant.

In order to achieve this object, the present invention provides a method for operation of a slurry feeder having a slurry supply tank for storing slurry to be fed to a polishing apparatus, wherein a flow rate of the given slurry to be fed from slurry supply tank to the polishing apparatus is set in such a manner that a flow velocity of slurry in slurry supply tank becomes faster than a sedimentation velocity of polishing particles in the slurry.

Because flow velocity of slurry in slurry supply tank is set to become faster than the sedimentation velocity of the polishing particles in the slurry, slurry can be fed to an object to be polished at a constant concentration.

BRIEF DESCRIPTION OF THE DRAWINGS

FIG. 10 is a table showing results of measurements for a variation of concentrations of slurry fed by changing a flow rate of slurry circulating through a slurry feeder of the polishing apparatus of FIG. 9.

DESCRIPTION OF REFERENCE NUMERALS AND SYMBOLS

Figure 1:
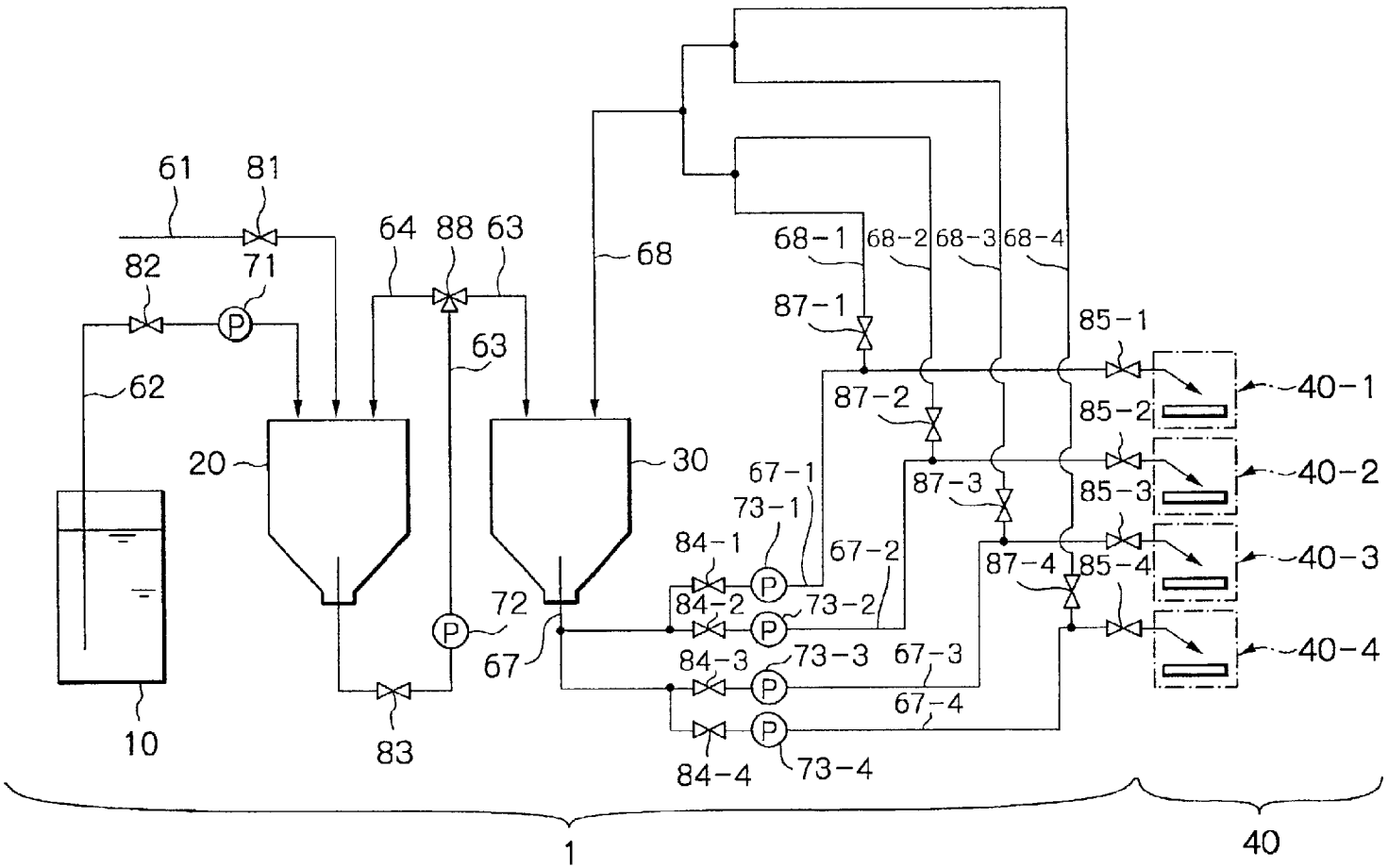
FIG. 1 is a system configuration diagram showing an example of a polishing apparatus according to the present invention.

1: slurry feeder
10: stock solution tank
20: preparation tank
30: slurry supply tank
40 (40-1, 2, 3, 4): chemical mechanical polishing apparatuses
61: deionized water (or chemical solution) line
62: stock solution feed pipe
63: solution feed pipe
64: circulating pipe
67 (67-1, 2, 3, 4): slurry feed pipes
68 (68-1, 2, 3, 4): circulating pipes
71: stock solution feed pump
72: solution feed pump
73-1, 2, 3, 4: slurry feed pumps
81: opening-closing valve
82: opening-closing valve
83: opening-closing valve
84-1, 2, 3, 4: opening-closing valves
85-1, 2, 3, 4: opening-closing valves
87-1, 2, 3, 4: opening-closing valves
88: three-way switching valve
146: slurry feed nozzle
201, 202: stock solution tanks
205: first pump
209: mixing tank
212: slurry supply tank
217: second pump
241: main body
251: polishing apparatus
252: slurry feeder
H: exhaust liquid
W: semiconductor wafer (an object to be polished)

DETAILED DESCRIPTION OF THE PREFERRED EMBODIMENTS

Modes of practicing the present invention will be described in more detail with reference to the accompanying drawings. FIG. 1 is a system configuration diagram illustrating an example of a polishing apparatus according to the present invention. As shown in the drawing, the polishing apparatus includes a slurry feeder 1 having, for example, a stock solution tank 10 with a stock solution of slurry stored therein, a preparation tank for adjusting the concentration of the stock solution of slurry to a given concentration by diluting the stock solution thereof with a deionized water (or a chemical solution), a slurry supply tank 30 for temporarily storing slurry of the given concentration in received from the preparation tank 20, and a plurality (four apparatuses in this embodiment) of chemical mechanical polishing apparatuses 40 (40-1 to 40-4, inclusive) to which slurry is fed from slurry supply tank 30.

To the preparation tank 20 is connected a deionized water (or chemical solution) line 61 through an opening-closing valve 81, and the preparation tank 20 is in turn connected to the stock solution tank 10 via a stock solution feed pipe 62 having a stock solution feed pump 71 and an opening-closing valve 82. Further, the preparation tank 20 is connected to slurry supply tank 30 via a solution feed pipe 63 installed with an opening-closing valve 83, a solution feed pump 72 and a three-way switching valve 88 that in turn is connected to a circulating pipe 64 communicating with the preparation tank 20.

To the slurry supply tank 30 is connected a slurry feed pipe 67 at a discharging side thereof. The slurry feed pipe 67 is branched into four branch slurry feed pipes 67-1, 67-2, 67-3 and 67-4 in a tree form. To the four branch slurry feed pipes 67-1, 67-2, 67-3 and 67-4 are connected opening-closing valves 84-1, 84-2, 84-3 and 84-4, slurry feed pumps 73-1, 73-2, 73-3 and 73-4, and opening-closing valves 85-1, 85-2, 85-3 and 85-4, respectively.

A top end of each of the branch slurry feed pipes 67-1, 67-2, 67-3 and 67-4 communicates with a slurry feed nozzle 146 (FIG. 8) of each of the chemical mechanical polishing apparatuses 40-1,40-2,40-3 and 40-3, respectively. On the other hand, circulating pipes 68-1,68-2, 68-3 and 68-4 branched from slurry feed pipes 67-1, 67-2, 67-3 and 67-4 are connected at an upstream side of opening-closing valves 85-1, 85-2, 85-3 and 85-4 of the slurry feed pipes 67-1, 67-2, 67-3 and 67-4, respectively. Each of the circulating pipes 68-1, 68-2, 68-3 and 68-4 is then united into a circulating pipe 68 that in turn is connected and returned to slurry supply tank 30. Further, the circulating pipes 68-1,68-2,68-3 and 68-4 are installed with opening-closing valves 87-1, 87-2, 87-3 and 87-4, respectively.

Figure 8:
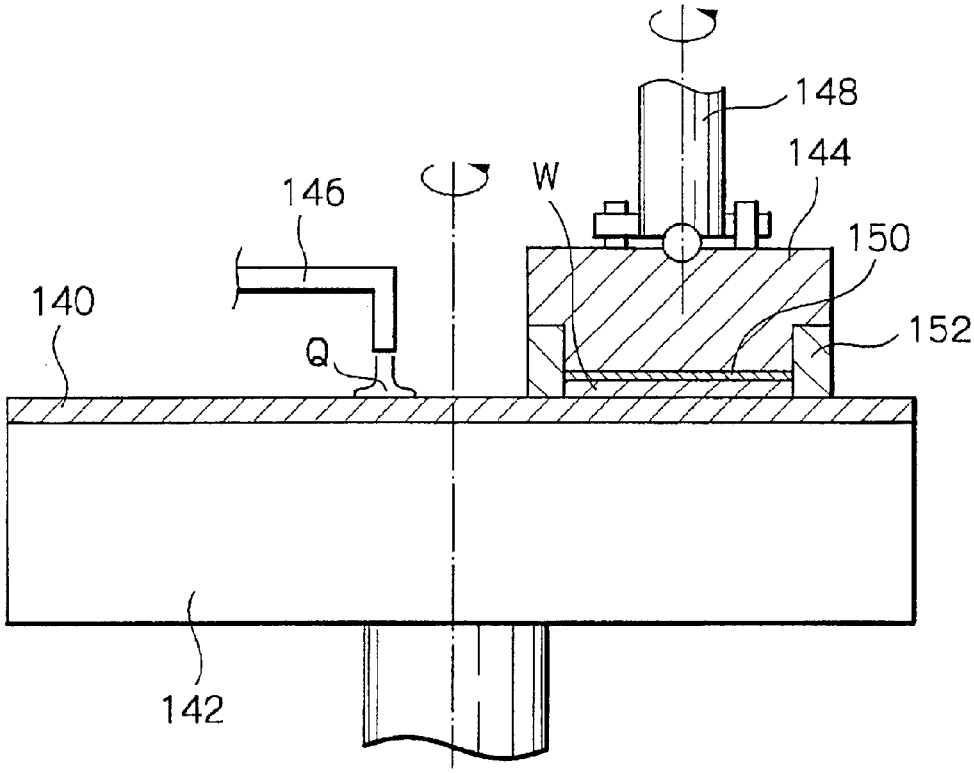
FIG. 8 is a view showing an essential portion of an example of a chemical mechanical polishing apparatus.

The chemical mechanical polishing apparatuses 40-1, 40-2, 40-3 and 40-4 each have substantially the same configuration as that in of the embodiment with reference to FIG. 8. Operations of the polishing apparatus will be described in more detail. In the following description, driving of each pump and valve may be controlled with a control unit (a control system) for electrically controlling tic driving of the pumps and valves.

As the opening-closing valve 82 is opened and the stock solution feed pump 71 is driven, slurry stock solution is fed from the stock solution tank 10 to the preparation tank 20. At the same time, the opening-closing valve 81 is opened to supply a deionized water (or a chemical solution) from a deionized water (or chemical solution) line 61 to the preparation tank 20 in which slurry stock solution is diluted with a deionized water (or chemical solution) to a given concentration.

During adjustment of concentration of slurry in the preparation tank 20 by diluting slurry stock solution with the deionized water or chemical solution, the solution in the preparation tank 20 may be mixed by rotating the solution with a stirring impeller (not shown) mounted in the preparation tank 20, or by circulating slurry in the preparation tank 20 from the solution feed pipe 63 through the circulating pipe 64 by opening the opening-closing valve 83 to switch the three-way switching valve 88 to a side of the circulating pipe 64 and driving the solution feed pump 72. During a period of time other than during a time of the adjustment of slurry by dilution, circulating operations for circulating slurry discharged from the preparation tank 20 back to the preparation tank 20, and stirring operations for stirring slurry with the stirring impeller in the preparation tank 20, are suspended.

Slurry to be used in this embodiment may be of an agglomerating nature in which polishing particles agglomerate into a larger mass when stress is imposed. More specifically, they may include SS-25 (product of Cabot), ILD 1300 (product of Rodel), and PLANERLITE 4213 (product of Fujimi).

Slurry adjusted to a given concentration in the preparation tank 20 is then transferred to slurry supply tank 30 by switching the three-way switching valve 88 to a side of the solution feed pipe 63 and driving the solution feed pump 72.

For example, when polishing operations are carried out by the chemical mechanical polishing apparatus 40-2, the opening-closing valves 84-2 and 85-2 are opened and slurry feed pump 73-2 is driven to feed slurry in slurry supply tank 30 to the chemical mechanical polishing apparatus 40-2. More specifically, as shown in FIG. 8, slurry is fed from slurry feed nozzle 146 onto polishing cloth 140 to polish semiconductor wafer W. During polishing operations, the opening-closing valve 87-2 is closed to feed all slurry supplied, by driving the slurry feed pump 73-2, to the chemical mechanical polishing apparatus 40-2 and to cause no slurry to circulate into slurry supply tank 30.

Further, during the polishing operations with the chemical mechanical polishing apparatus 40-2, all the opening-closing valves 84-1, 84-3 and 844, 85-1, 85-3 and 854 as well as 87-1, 87-3 and 87-4 of the rest of the chemical mechanical polishing apparatuses, i.e., 40-1, 40-3 and 40-4, respectively, which is not subjected to polishing operations, are closed and slurry feed pumps 73-1, 73-3 and 734 are suspended to allow no slurry to be transferred into pipe systems associated with the polishing apparatuses not performing polishing operations.

In other words, in accordance with the present invention, operations of slurry feed pumps 73-1, 73-3 and 73-4 for the chemical mechanical polishing apparatuses 40-1, 40-3 and 40-4, respectively, are suspended during idling. At the same time, all slurry discharged from slurry supply tank 30 by slurry feed pump 73-2 is fed to the chemical mechanical polishing apparatus 40-2 in during a process of polishing.

Figure 2:
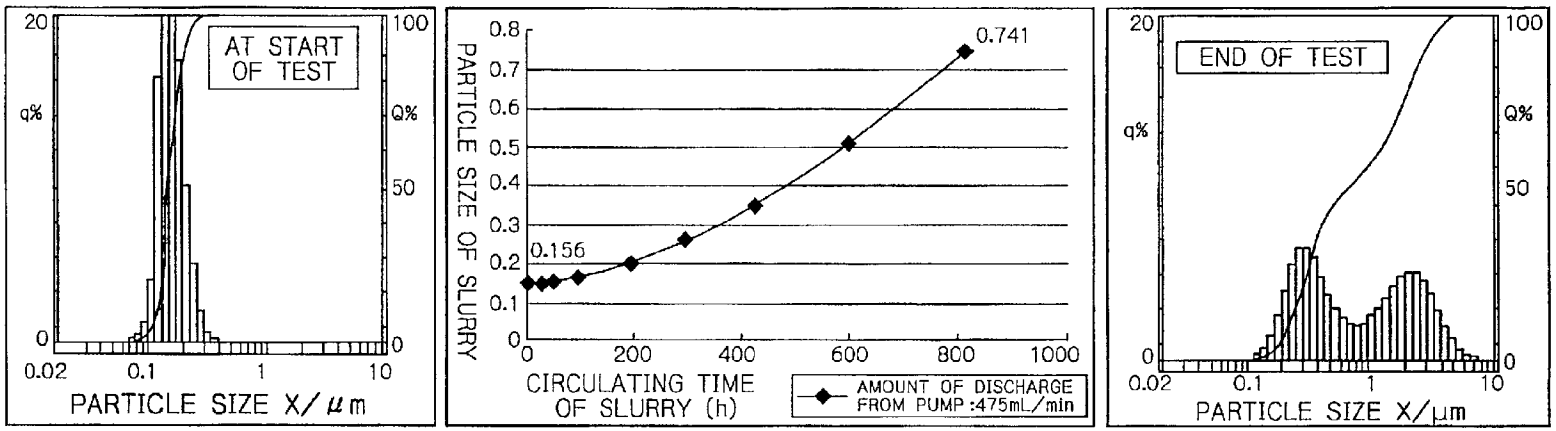
FIG. 2 is an illustration of a state of a variation in particle sizes of slurry having a high agglomerating property upon carrying out the circulating operations for returning slurry discharged from a slurry supply tank back to slurry supply tank when a flow rate of slurry is set at 475 ml per minute.
Figure 3:
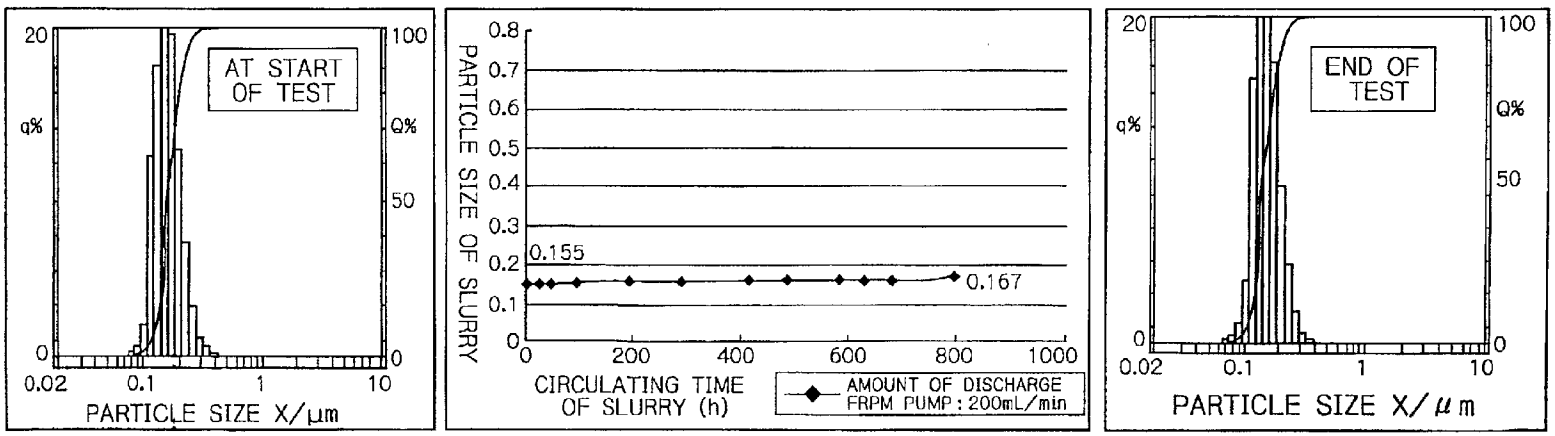
FIG. 3 is an illustration of a state of a variation in particle sizes of the slurry having a high agglomerating property upon carrying out circulating operations for returning slurry discharged from a slurry supply tank back to slurry supply tank when a flow rate of slurry is set at 200 ml per minute.

Suspending circulation of slurry in slurry supply tank 30 and feeding the slurry exclusively to the chemical mechanical polishing apparatus or/and apparatuses 40-1, 40-2, 40-3 or/and 40-4 during a process of polishing are for the reasons as will be described hereinafter. FIGS. 2 and 3 are graphs each illustrating a state in which particle sizes of a slurry are varied upon the circulating operations for circulating slurry, having a high agglomerating property, discharged from slurry supply tank 30, which is used in the embodiment as described above, back to the slurry supply tank 30. FIGS. 2 and 3 illustrate a state of a variation in particle sizes of the slurry when a flow rate of the slurry discharged from the pump (a flow rate of slurry being circulated) is set at 475 ml per minute and 200 ml per minute, respectively.

For each of the central graphs of FIGS. 2 and 3, the axis of abscissas represents the circulating time (hr) for circulating slurry, and the axis of ordinates represents particle sizes (micron) of the slurry corresponding to a 50% Q value of a cumulative distribution curve. In FIGS. 2 and 3, the axis of abscissas for each of the left-hand and right-hand graphs represents particle sizes (in micron) of slurry, while the axis of ordinates for the left-hand graphs represents a rate of distribution with respect to each particle size and the axis of ordinates for the right-hand graphs represents a rate (%) of a cumulative distribution curve from the smaller particle sizes to larger particle sizes. Further, the graphs on the left-hand side illustrate distribution of particle sizes of slurry before testing and the graphs on the right-hand side illustrate distribution of particle sizes of slurry after testing (during a final measurement time).

As shown in FIGS. 2 and 3, it is found that particle sizes of slurry become larger as the amount of slurry discharged from the pump becomes larger, while particle sizes of the slurry are varied little as the amount of slurry discharged therefrom becomes smaller. Therefore, as in the present invention, when the amount of slurry to be fed is controlled so as to become smaller, particle sizes of slurry to be fed to the chemical mechanical polishing apparatuses 40-1, 40-2, 40-3 and 40-4 can be sustained within an appropriate given scope of slurry particle sizes, and the semiconductor wafer W can be subjected to polishing operations in an optimal way.

In particular, in this embodiment, one slurry feed pump is connected to each one of the chemical mechanical polishing apparatus. This configuration can readily control supply of slurry to the chemical mechanical polishing apparatus during a process of polishing and suspension (idling) of polishing operations in the manner as described above. Further, this configuration allows a ready supply of all slurry in a state in which slurry is not agglomerating (or agglomerating little), to the chemical mechanical polishing apparatus during a process of polishing without circulating slurry discharged from slurry supply tank 30.

Figure 4:
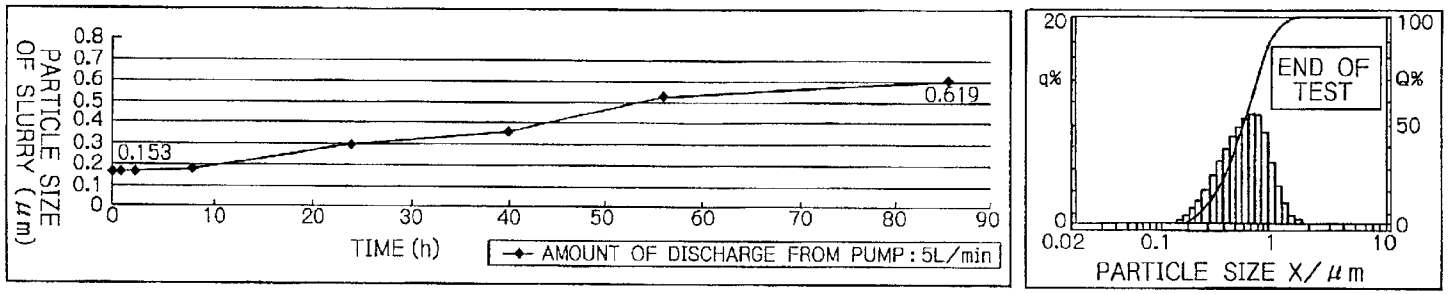
FIG. 4 is an illustration of a state of a variation in particle sizes of slurry having a high agglomerating property upon carrying out circulating operations for returning slurry discharged from a preparation tank back to the preparation tank when a flow rate of slurry discharged from a pump (the i.e. a flow rate of slurry to be circulated) is set at 5 liters per minutes.
Figure 5:
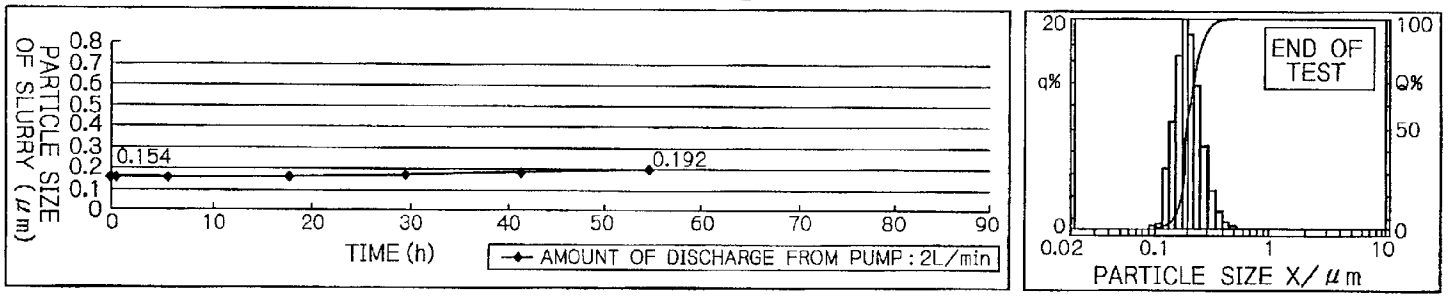
FIG. 5 is an illustration of a state of a variation in particle sizes of slurry having a high agglomerating property upon carrying out the circulating operations for returning slurry discharged from a preparation tank back to the preparation tank when a flow rate of slurry discharged from a pump (i.e. a flow rate of slurry to be circulated) is set at 2 liters per minute.
Figure 6:
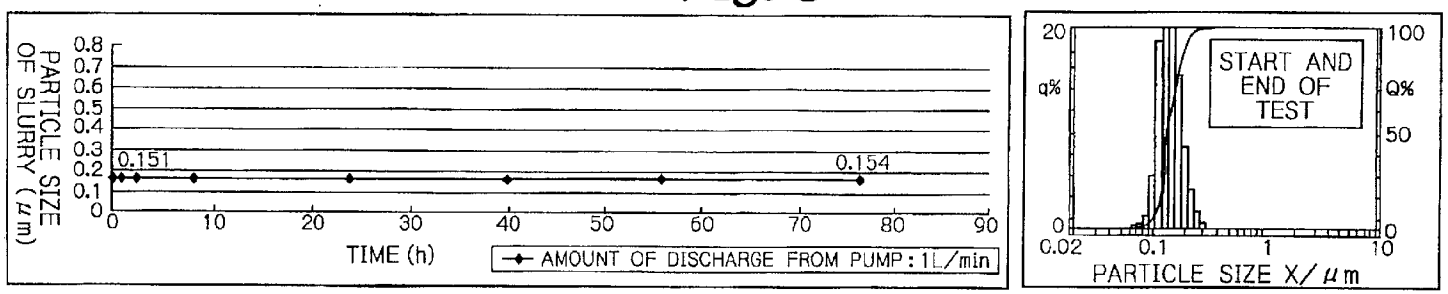
FIG. 6 is an illustration of a state of a variation in particle sizes of slurry having a high agglomerating property upon carrying out circulating operations for returning slurry discharged from a preparation tank back to the preparation tank when a flow rate of slurry discharged from a pump (i.e. a flow rate of slurry to be circulated) is set at 1 liter per minute.

FIGS. 4 to 6 are graphs each illustrating a state of a variation in particle sizes of slurry having a high agglomerating property, as used in this embodiment, upon carrying out circulating operations for circulating slurry to return slurry discharged from the preparation tank 20 back to the preparation tank 20. FIGS. 4 to 6 illustrate states of variations in particle sizes of slurry, when a flow rate of slurry discharged from the pump (a flow rate of the slurry to be circulated) is set to 5 liters per minute, 2 liters per minute, and 1 liter per minute, respectively. The axes of abscissas and ordinates of each graph are the same as in the case of FIG. 2 or FIG. 3.

As shown in FIGS. 4 to 6, it is found that particle sizes of slurry become larger as an amount of slurry discharged from the pump becomes larger, while particle sizes of the slurry vary little as an amount of slurry discharged from the pump becomes smaller. Therefore, as in the present invention, when an amount of the slurry to be fed is rendered smaller by controlling, so as to suspend the circulating operations for returning slurry discharged from the preparation tank 20 back to the preparation tank 20. And also to suspend stirring operations for stirring slurry in the preparation tank 20 during a period of time other than during a time of adjustment for diluting a slurry stock solution, particle sizes of slurry to be fed to slurry supply tank 30 can be sustained within a given appropriate scope of particle sizes. This permits optimal polishing operations for polishing semiconductor wafer W.

Figure 7:
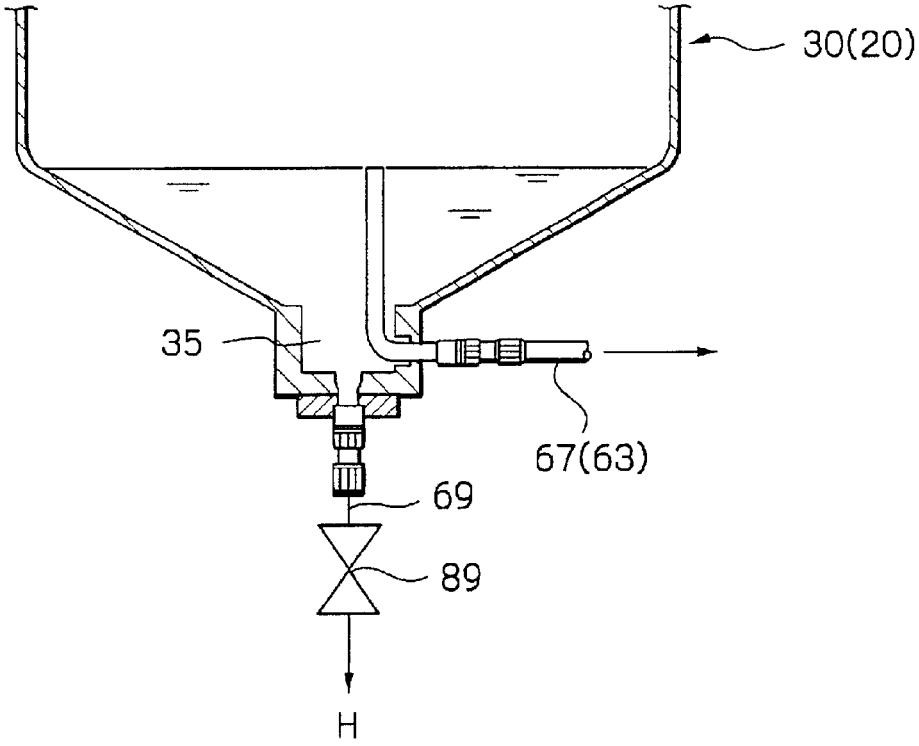
FIG. 7 is a brief sectional view showing a portion in the vicinity of a bottom portion of a slurry supply tank and preparation tank.

FIG. 7 is a brief sectional view showing a portion in the vicinity of a bottom portion of slurry supply tank 30 (and the preparation tank 20). As shown in FIG. 7, a portion of the slurry supply tank 30 (and the preparation tank 20) connected to slurry feed pipe 67 (and the solution feed pipe 63) is configured such that a top end of the slurry feed pipe 67 (and the solution feed pipe 63) protrudes upwardly from the bottom portion of slurry supply tank 30 (and the preparation tank 20). The bottom portion of the slurry supply tank 30 (and the preparation tank 20) with slurry feed pipe 67 (and the solution feed pipe 63) protruding therefrom is provided with a trap section 35 in a depressed form.

This configuration can prevent slurry agglomerate settled in the trap section from being discharged directly from the top end of slurry feed pipe 67 (and the solution feed pipe 63), even if the slurry would be settled therein due to suspension of operations of the slurry supply tank 30 (and the preparation tank 20). This configuration can also assist in sustaining particle sizes of slurry to be fed at a given appropriate level and carrying out optimal polishing operations for polishing semiconductor wafer W. In FIG. 7, a pipe 69 and an opening-closing valve 89 are disposed for discharging an exhaust liquid H, and these elements are omitted from FIG. 1.

In the above embodiment, circulating pipes 68, 68-1, 68-2, 68-3 and 68-4 are disposed to form a circulating pipe system in slurry supply tank 30. It is to be noted however, that this pipe system is not used in this embodiment because it is not needed to return slurry to slurry supply tank 30 by circulating slurry. For this reason, it is not necessary to locate the pipe system in the present invention.

Although the present invention has been described by way of the embodiments as described above, it is to be understood that the present invention is not limited in any respect to the embodiments as described above and that it encompasses various variations within the scope and spirit claimed in the claims and described in the specification and drawings. It is also to be understood that any shape, configuration and material which are not referred to specifically in the claims and the description be encompassed within the scope and spirit of this invention as long as they can demonstrate actions and effects sought to be achieved by the invention. It is needless to say that, for example, the chemical mechanical polishing apparatuses are not restricted to the one having the structure as shown in FIG. 8 and that they may have a variety of different structures.

Figure 9:
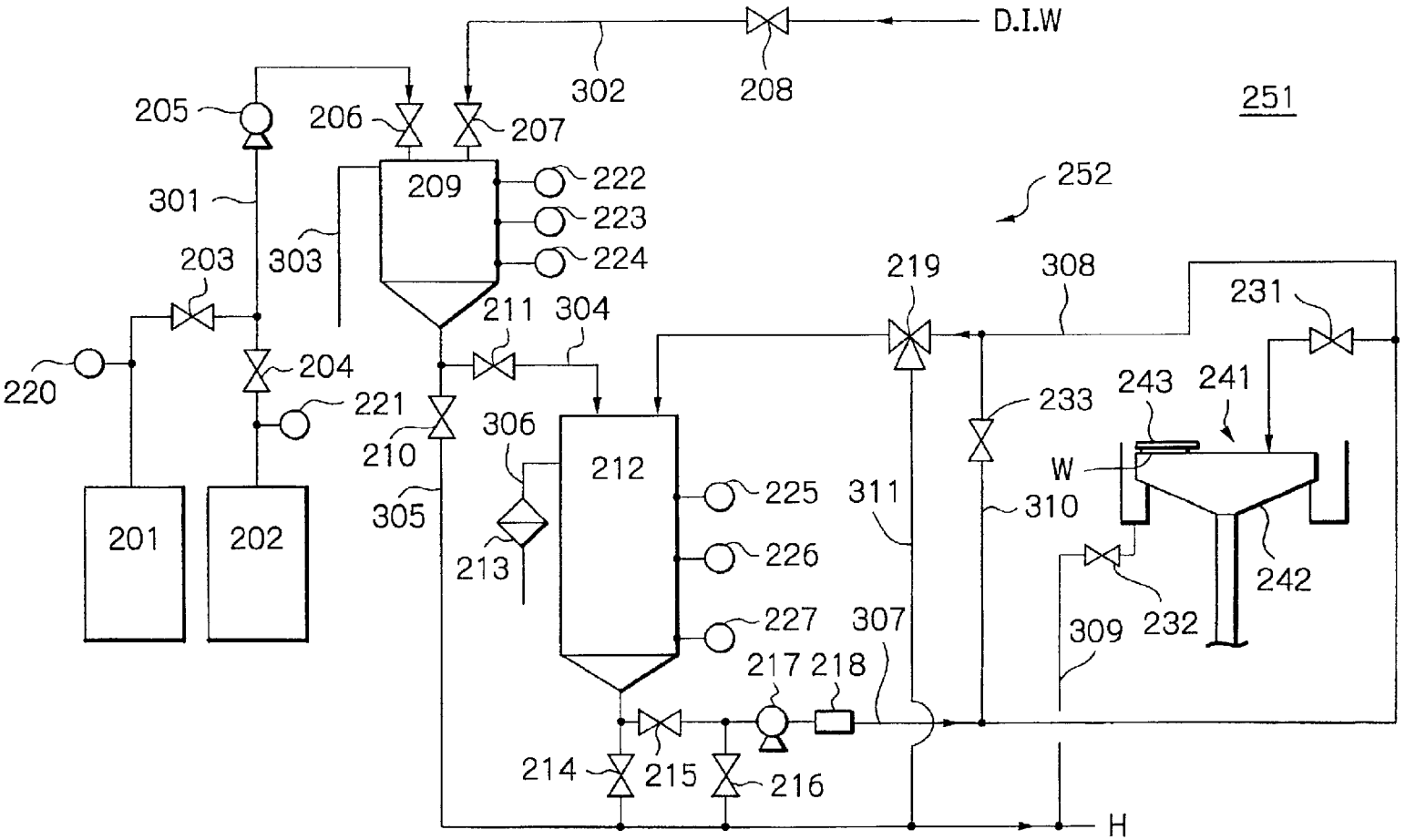
FIG. 9 is a block diagram showing a configuration of a polishing apparatus according to an embodiment of the present invention.

Modes of practicing the present invention will be described with reference to the accompanying drawings. FIG. 9 is a block diagram showing a configuration of a polishing apparatus 251 for polishing a semiconductor wafer in accordance with an embodiment of the present invention. The polishing apparatus 251 include includes a main body 241 and a slurry feeder 252.

The main body 241 of the polishing apparatus includes a turntable 242, working as a polishing table for use with the present invention, and a top ring 243. The top ring 243 attaches to and holds a semiconductor wafer W. The semiconductor wafer W is clamped between the turntable 242 and the top ring 243 and polished by rotating the turntable 242.

The slurry feeder 252 includes stock solution tanks 201 and 202 each containing a stock solution of slurry, a mixing tank 209 for mixing the stock solution of the slurry with a deionized water, a supply tank 212 working as a slurry supply tank for feeding slurry of a concentration in use to the main body 241 of the polishing apparatus, a first pump 205 for transferring stock solution of slurry to the mixing tank 209, and a second pump 217 for transferring slurry to the main body 241 of the polishing apparatus.

A stock solution feed line 301 for feeding the stock solution of slurry connects the stock solution tanks 201 and 202 and the mixing tank 209, and the first pump 205 is disposed in between this line. A stock solution detecting sensor 220 and a valve 203 are disposed in the stock solution feed line 301 in the vicinity of the stock solution tank 201, and a stock solution detecting sensor 221 and a valve 204 are disposed in the stock solution feed line 301 in the vicinity of the stock solution tank 202. A valve 206 is provided downstream of the first pump 205 in the stock solution feed line 301 in the vicinity of the mixing tank 209.

To the mixing tank 209 is connected a deionized water feed line 302 for feeding a deionized water from a plant line (not shown), and the deionized water feed line 302 is installed with valves 207 and 208. The valve 207 is located in the vicinity of the mixing tank 209.

Liquid level detecting sensors 222, 223 and 224 are mounted, in an order of liquid level height, on the mixing tank 209 in which is of a generally cylindrical for and disposed vertically. The liquid level detecting sensor 224 is disposed to detect a lowermost liquid level. Further, an overflow line 303 is disposed on the mixing tank 209 at a level higher than a level detected by the liquid level detecting sensor 222 to allow an overflow of mixed slurry.

A mixed slurry feed line 304 connects the mixing tank 209 to a slurry supply tank 212. The mixed slurry feed line 304 is in turn provided with a valve 211. The mixed slurry feed line 304 is branched at a location upstream of the valve 211 into a discharging line 305 which in turn is provided with a valve 210. The mixed slurry feed line 304 is further connected to an uppermost portion of slurry supply tank 212, or in the vicinity of the uppermost portion thereof. Therefore, mixed slurry is allowed to flow vertically downwardly from a top of slurry supply tank 212 toward a bottom thereof.

The slurry supply tank 212 is provided with liquid level detecting sensors 225,226 and 227 in an order of liquid level height. The liquid level detecting sensor 227 is disposed to detect a lowermost liquid level. Further, an overflow line 306 is disposed at a level higher than a liquid level detected by the liquid level detecting sensor 225 to allow an overflow of slurry fed to slurry tank 212. The overflow line 306 is provided with a filter 213 that can work s as to reduce an amount of air entering into slurry supply tank 212 and prevent foreign matter from entering into slurry supply tank 212.

A slurry feed line 307 connects the slurry supply tank 212 to the main body 241 of the polishing apparatus and is provided with a valve 215 in the vicinity of slurry supply tank 212. A second pump 217 is mounted on in slurry feed line 307 at a location downstream of the valve 215, and a damper 218 for controlling pulsation of a discharging pressure from the second pump 217 is in turn mounted in the slurry feed line at a location downstream of the second pump 217. A valve 231 is further provided on in slurry feed line 307 at a location downstream of the damper 218 and in the vicinity of the main body 241 of the polishing apparatus. As valve 231 is opened, slurry is fed to the turntable 242.

A line is provided with a valve 214, and this line connects slurry feed line 307 upstream of the valve 215 to the discharging line 305. Another line connects slurry feed line 307 downstream of the valve 215 to the discharging line 305, and is provided with a valve 216. The slurry feed line 307 is further connected to a vertical bottommost portion of slurry supply tank 212, thereby allowing slurry flown flowed vertically downwardly in slurry supply tank 212 to be fed from slurry supply tank 212 to slurry feed line 307.

Slurry not fed to the turntable 242 from slurry supply tank 212 is returned to slurry supply tank 212 through a circulating line 308 for use as a slurry-returning path in. On the other hand, slurry fed to the turntable 242 from the slurry supply tank 212 is discharged after use for polishing as a waste fluid into a discharging line 309 having a valve 232. The circulating line 308 is disposed so as to allow the returned slurry to flow vertically downwardly into slurry supply tank 212.

Slurry is fed from slurry feed line 307 to the turntable 242 of the main body 241 of the polishing apparatus through the valve 231, and is used for polishing semiconductor wafer W. A bypass line 310 bypasses the main body 241 of the polishing apparatus from slurry feed line 307, is provided with a valve 233, and connects an upstream side of a three-way valve 219 to a downstream side of the damper 218. Another bypass line 311 is branched from the circulating line 308 at the three-way, valve 219 and is connected to the discharging line 305. Slurry flowing through the circulating line 308 is returned to the slurry supply tank 212 in usual cases; however, the slurry can also be discharged into the discharging line 305 without being returned to slurry supply tank 212 by switching the three-way valve 219.

Next, a description will be given regarding actions of the polishing apparatus 251 according to an embodiment of the present invention.

(1) A stock solution of slurry is sucked from either one of the stock solution tanks 201 and 202, where the stock solution of slurry is stored, through the valve 203 or the valve 204 by virtue of the first pump 205, and is then fed to the mixing tank 209. When the stock solution of slurry is to be sucked from the stock solution tank 201, the valve 203 is opened and the valve 204 is closed. On the other hand, when the stock solution of slurry is to be sucked from the stock solution tank 202, the valve 204 is opened and the valve 203 is closed. Management of an amount of the stock solution of the slurry to be fed to the mixing tank 209 may be conducted by suspending the operation of the first pump 205 and closing the valve 206 when a liquid surface level of slurry in the mixing tank 209 is detected by the liquid level detecting sensor 224 of the mixing tank 209.

(2) After the stock solution of slurry has been fed to the mixing tank 209, the valves 207 and 208 are opened to feed a deionized water to the mixing tank 209 from the deionized water feed line 302. An amount of the deionized water to be fed to the mixing tank 209 can be managed by suspending a pump (not shown) for feeding the deionized water, or closing the valve 207 when a liquid surface level of solution in the mixing tank 209 is detected by the liquid level detecting sensor 223 of the mixing tank 209. The liquid level detecting sensor 222 is a sensor for sensing an overflow of the fluid from the mixing tank 209 in a case where the liquid level detecting sensors 223 and 224 do not work. When liquid level of the stock solution of the slurry has been detected by the liquid level detecting sensor 222, the first pump 205 is suspended and the valves 206, 207 and 203 (or 204) are closed.

(3) After the deionized water has been fed to the mixing tank 209, valve 211 is opened to allow a diluted slurry in the mixing tank 209 to drop into slurry supply tank 212 by virtue of gravity and transfer all the diluted slurry to slurry supply tank 212. It is to be noted that the mixing tank 209 is located at a level adequately higher than slurry supply tank 212.

(4) Steps (1) to (3) above, inclusive, are repeated until a liquid surface level of slurry in slurry supply tank 212 rises and the liquid surface level thereof is detected by the liquid level detecting sensor 226. After a liquid level of slurry in the supply tank 212 has been detected by the liquid level detecting sensor 226 and all slurry in the mixing tank 209 has been transferred to the supply tank, then the valve 21 1 is closed. Management of transferring all slurry in the mixing tank 209 to the supply tank 212 may be effected by a timer control.

More specifically, after the liquid level of slurry has been detected by the liquid level detecting sensor 226, the opened valve 211 is controlled to be closed by a timer (not shown) that is set to begin operating the valve 211 after an elapse of the time when slurry in a total amount of 3 liters drops by gravity from the mixing tank 209 to slurry supply tank 212. It is to be noted, however, that transfer of slurry in the total amount of 3 liters from the mixing tank 209 to slurry supply tank 212 is set so as to have all slurry transferred from the mixing tank to the supply tank.

After slurry has been fed to slurry supply tank 212, the second pump 217 starts feeding slurry to the main body 241 of the polishing apparatus through slurry feed line 307 by virtue of the valve 215. An amount of slurry discharged by the second pump 217 may be the addition of tic an amount of slurry fed to the main body 241 of the polishing apparatus to an amount (at least 5 liters per minute) of slurry circulated and returned through the circulating line 308 to slurry supply tank 212. If it is not be necessary to feed slurry to the main body 241 of the polishing apparatus, all slurry discharged by virtue of the second pump 217 is circulated from slurry feed line 307 through the circulating line 308 and returned to slurry supply tank 212. At this time, the valve 231 is closed.

When slurry is continually fed to the main body 241 of the polishing apparatus and a liquid level of slurry in the supply tank 212 is no longer detected by the liquid level detecting sensor 226, then the steps (1) to (4) above, inclusive, are carried out. When a liquid level of slurry in the supply tank 212 is no longer detected by the liquid level detecting sensor 227, operation of the second pump 217 is to be suspended, and the polishing apparatus is to be halted.

It is preferred that, when a liquid level of slurry is no longer detected in the supply tank 212 by the liquid level detecting sensor 227, an amount of slurry to remain in slurry supply tank 212 is an amount larger than an amount corresponding to an amount necessary for circulating slurry through the circulating line 308 by the second pump 217 plus an amount of slurry required for polishing one surface of the semiconductor wafer W.

More specifically, it is safe when a polishing operation is carried out by virtue of the timer control for a given period of time after the liquid level detecting sensor 226 no longer detects a liquid level of slurry in the supply tank 212, and operation of the second pump 217 is suspended in order to prevent idling of the second pump 217 after the liquid level detecting sensor 227 no longer detects a liquid level of slurry.

Whether depletion of stock solution of slurry from the stock solution tank 201 or the stock solution tank 202 results is determined by stock solution of slurry no longer being detected by the stock solution detecting sensor 220 or stock solution detecting sensor 221, when the stock solution of the slurry is being sucked by the first pump 205. A reason for locating two stock solution tanks, 201 and 202, is because a stock solution of slurry can be fed continuously to the main body 241 of the polishing apparatus even if one of the stock solution tanks becomes empty.

In other words, an arrangement stock solution tanks allows a stock solution to be sucked from either one of these tanks by virtue of the first pump 205 even if the other tank becomes empty. If one of the stock solution tanks becomes empty, an operator can exchange the empty tank before the other tank becomes empty (for example, immediately after the one tank became empty).

When the liquid level detecting sensor 223 or 224 of the mixing tank 209 does not work, or when slurry is continuously fed to the mixing tank 209 even if the sensor does work, an upper limit of a fluid level of the mixed slurry in the mixing tank 209 may be controlled by the liquid level detecting sensor 222. In other words, in a case where the a liquid level of the mixed slurry is detected by the liquid level detecting sensor 222, operation of the first pump 205 and a pump (not shown) for feeding a deionized water, are suspended. If the liquid level detecting sensor 222 also does not work, or if the first pump 205 or the pump (not shown) for feeding the deionized water is not suspended even if the liquid level detecting sensor 222 does work, then fluid is discharged from the overflow line 303 disposed at an upper side wall portion of the mixing tank 209.

If the liquid level detecting sensor 225 or 226 of the slurry supply tank 212 does not work, or if fluid is continuously fed into the slurry supply tank 212 even if the liquid level detecting sensor 225 or 226 does work, the valve 211 is closed by the timer control in the manner as described above. Therefore, no slurry is fed to the slurry supply tank 212. If the valve 211 is not be closed by the timer control and a liquid level of slurry in slurry supply tank 212 further rises then fluid is discharged from the overflow line 306 disposed at an upper side wall portion of slurry supply tank 212.

During transferring of a stock solution of slurry from the stock solution tanks 201 or 202 to the mixing tank 209 by virtue of the first pump 205, timer control is carried out by virtue of a timer (not shown) so as to fail to interfere with operation of other instruments for a certain period of time even if the stock solution detecting sensors 220 or 221 do not detect the stock solution of slurry. If the stock solution of the slurry is not detected by the stock solution detecting sensor 220 or 221 over a predetermined period of time, then the operation of the first pump 205 is suspended.

When fluid in the mixing tank 209 is to be discharged, valve 210 is opened. On the other hand, when fluid in slurry supply tank 212 is to be discharged, valve 214 is opened. When fluid is discharged from slurry feed line 307 in order to subject the second pump 217 to maintenance, valve 215 is closed and valve 216 is opened.

Next, a description will be given regarding a shape, and the like of the slurry supply tank 212 (buffer tank) in this embodiment of the present invention. The slurry supply tank 212 is of a generally cylindrical shape and is vertically disposed. The slurry supply tank 212 has a tank diameter of 200 mm, a sectional tank area of 31,400 $mm^2$, and a tank height of approximately 800 mm. A pipe size of each of slurry feed line 307 and the circulating line 308 is ¾ inch (a pipe inner diameter of 15.88 mm).

A circulating flow rate (a flow rate of fluid circulating through the circulating line 308) is at least 5 liters per minute. At this time, a vertical flow velocity of slurry in slurry supply tank 212 is set to be at least 0.00264 m/s, and a flow velocity of fluid in the circulating line is set to be at least 0.42 m/s. Under these conditions, it is confirmed that sedimentation of polishing particles in slurry supply tank 212 is avoided, and that concentration of the slurry is uniform. The generally cylindrical shape of slurry supply tank 212 serves to smoothly flow slurry.

Next, a description will be given with reference to the table of FIG. 10 and optionally to FIG. 9, regarding the results of measurements pertaining to the slurry feeder 252 of this embodiment for a variation in uniformity of concentration of slurry when amounts of slurry flowing in slurry supply tank 212 and through slurry feed line 307, and circulating through the circulating line 308, are changed. During these measurements, the valve 231 is closed. Pipe sizes of slurry feed line 307 and the circulating line 308, and a tank size and the sectional tank size of slurry supply tank 212 are set in the manner as described above.

A circulating flow rate of the slurry was divided into three cases; that is, 10 liters per minute for case 1, 5 liters per minute for the case 2, and 1.4 liters per minute for case 3. And, a deviation of concentration of fed slurry from an initial concentration thereof is measured for each case. At this time, a flow velocity through the pipes for each case is set: 0.842 m/s for case; 0.421 m/s for case 2; and 0.118 m/s for case 3; and a flow velocity in slurry supply tank 212 is set: 0.00531 m/s for case 1; 0.00265 m/s for case 2; and 0.00074 m/s for case 3. As slurry, there is used a settling slurry of a ceria or alumina type and an initial concentration of slurry is set to be 4.70% by weight for each of case 1 and case 2, and 4.5% by weight for case 3.

A variation of the concentration of the slurry in the slurry supply tank 212 from an initial concentration thereof was found to be less than +/−4% for case 1, less than +/−4% for case 2, and less than +/−32% for the case 3. From these results, it was found that the cases 1 and 2 satisfy a determination standard of less than +/−10%. Further, it is found from the above results that for slurry feeder in this embodiment of the present invention, slurry can be fed at a uniform concentration when a circulating flow rate is set to be at least 5 liters per minute.

It is preferred that a circulating flow rate of slurry is set to be in the range of from 5 to 22 liters per minute, because too great a circulating flow velocity of slurry may adversely affect the polishing performance due to agglomeration of the polishing particles. It is to be noted that the slurry feeder 252 in this embodiment of the present invention does not require any type of a stirring device in order to stir slurry in slurry supply tank 212, so that there is no risk of raising a temperature of the slurry which would otherwise result from stirring slurry with a stirring device. It is further preferred that a determination standard for variation of concentration of slurry in slurry supply tank 212 from an initial concentration thereof is set to be less than +/−5%.

Next mixing/diluting of a stock solution of slurry with deionized water in the mixing tank 209 is carried out by utilizing a flow velocity at which the deionized water is fed to the mixing tank 209. It is preferred that a feeding flow velocity is set to be at least 0.332 m/s and that at least a half (1.5 liters) of an amount of adjustment at a time of mixing/diluting at this flow velocity is set to have a feeding flow rate of at least 4 liters per minute. In this embodiment of the present invention, an outer diameter and an inner diameter of a pipe for the deionized water feed line 302 are set to be 12.7 mm and 9.5 mm, respectively.

Effects of the Invention

As described above, the present invention can demonstrate the remarkable effects in that, even if slurry for use with the chemical mechanical polishing apparatus is in of an agglomerating nature, the slurry can be supplied to the chemical mechanical polishing apparatus in an appropriate state without accelerating agglomeration of slurry.

As described above, the present invention presents advantages in that a vertical flow velocity of slurry in a slurry supply tank can be made greater than a sedimentation velocity of polishing particles in slurry because a horizontal sectional area of slurry supply tank is set to be smaller than Q/V, in that concentration of slurry in slurry supply tank can be sustained at a constant level because slurry is stirred due to flow of slurry through a storage tank, and in that the concentration of slurry to be fed to a polishing apparatus can be made constant.

What is claimed is:

1. A slurry feeder comprising:

a slurry supply tank for holding slurry at a given concentration;

a slurry feed pipe connected to said slurry supply tank;

a slurry feed pump for pumping slurry from said slurry supply tank to a polishing apparatus via said slurry feed pipe;

a preparation tank for having prepared therein slurry having the given concentration by mixing and diluting a stock solution of slurry with de-ionized water or a chemical liquid, said preparation tank being in fluid communication with said slurry supply tank so as to supply the slurry having the given concentration from said preparation tank to said slurry supply tank; and a control system for (i) suspending operation of said slurry feed pump during a time period when the slurry is not being supplied to the polishing apparatus and the polishing apparatus is performing a polishing operation, and (ii) suspending the mixing of the stock solution of slurry with the de-ionized water or chemical solution during a time period when the stock solution of slurry is not being diluted by the de-ionized water or chemical liquid, wherein the polishing apparatus includes turntables, and a said slurry feed pump is provided for each of the turntables.

2. A slurry feeder comprising:

a slurry supply tank for holding slurry at a given concentration;

a slurry feed pipe connected to said slurry supply tank;

a slurry feed pump for pumping slurry from said slurry supply tank to a polishing apparatus via said slurry feed pipe;

a preparation tank for having prepared therein slurry having the given concentration by mixing and diluting a stock solution of slurry with de-ionized water or a chemical liquid, said preparation tank being in fluid communication with said slurry supply tank so as to supply the slurry having the given concentration from said preparation tank to said slurry supply tank;

a circulation system for conveying slurry, having the given concentration, discharged from said preparation tank back into said preparation tank; and a control system for (i) suspending operation of said slurry feed pump during a time period when the slurry is not being supplied to the polishing apparatus and the polishing apparatus is performing a polishing operation, (ii) suspending operation of said circulation system so as to stop slurry discharged from said preparation tank from being conveyed back into said preparation tank during a time period when the stock solution of slurry is not being diluted by the de-ionized water or chemical liquid, and (iii) suspending the mixing of the stock solution of slurry with the de-ionized water or chemical solution during a time period when the stock solution of slurry is not being diluted by the de-ionized water or chemical liquid.

3. The slurry feeder according to claim 2, wherein a portion of said slurry feed pipe is positioned within said slurry supply tank such that an inlet of said slurry feed pipe is spaced from a bottom of said slurry supply tank so as to prevent slurry agglomerate settled on the bottom of said slurry supply tank from entering into the inlet of said slurry feed pipe.

4. The slurry feeder according to claim 3, wherein the polishing apparatus includes turntables, and a said slurry feed pump is provided for each of the turntables.

5. A slurry feeder comprising:

a slurry supply tank for holding slurry at a given concentration;

a slurry feed pipe connected to said slurry supply tank;

a slurry feed pump for pumping slurry from said slurry supply tank to a polishing apparatus via said slurry feed pipe: and a control system for suspending operation of said slurry feed pump during a time period when slurry is not being supplied to the polishing apparatus and the polishing apparatus is performing a polishing operation, wherein a portion of said slurry feed pipe is positioned within said slurry supply tank such that an inlet of said slurry feed pipe is spaced from a bottom of said slurry supply tank so as to prevent slurry agglomerate settled on the bottom of said slurry supply tank from entering into the inlet of said slurry feed pipe.

6. The slurry feeder according to claim 5, wherein the polishing apparatus includes turntables, and a said slurry feed pump is provided for each of the turntables.

7. A slurry feeder for feeding slurry to a polishing apparatus, comprising:

a slurry supply tank for holding a slurry that includes polishing particles and is to be supplied to a polishing apparatus at a flow rate Q, the polishing particles having a sedimentation velocity V, wherein a horizontal sectional area of said slurry supply tank is less than Q/V.

8. A polishing apparatus comprising:

a polishing table;

a slurry feeder including (i) a slurry supply tank for holding slurry at a given concentration, (ii) a slurry feed pipe connected to said slurry supply tank, (iii) a slurry feed pump for pumping slurry from said slurry supply tank to said polishing table via said slurry feed pipe, (iv) a preparation tank for having prepared therein slurry having the given concentration by mixing and diluting a stock solution of slurry with de-ionized water or a chemical liquid, said preparation tank being in fluid communication with said slurry supply tank so as to supply slurry having the given concentration from said preparation tank to said slurry supply tank; and (v) a control system for (a) suspending operation of said slurry feed pump during a time period when the slurry is not being supplied to said polishing table and said polishing table is performing a polishing operation, and (b) suspending the mixing of the stock solution of slurry with the de-ionized water or chemical solution during a time period when the stock solution of slurry is not being diluted by the de-ionized water or chemical liquid;

a slurry-return path for returning to said slurry supply tank slurry that is supplied from said slurry supply tank and not used by said polishing table; and another polishing table, wherein said slurry feeder further includes (vi) another slurry feed pipe connected to said slurry supply tank, and (vii) another slurry feed pump for pumping slurry from said slurry supply tank to said another polishing table via said another slurry feed pipe.

9. A polishing apparatus comprising:

a polishing table; and a slurry feeder including (i) a slurry supply tank for holding slurry at a given concentration, (ii) a slurry feed pipe connected to said slurry supply tank, (iii) a slurry feed pump for pumping slurry from said slurry supply tank to said polishing table via said slurry feed pipe, (iv) a preparation tank for having prepared therein slurry having the given concentration by mixing and diluting a stock solution of slurry with de-ionized water or a chemical liquid, said preparation tank being in fluid communication with said slurry supply tank so as to supply slurry having the given concentration from said preparation tank to said slurry supply tank, (v) a circulation system for conveying slurry, having the given concentration, discharged from said preparation tank back into said preparation tank, and (vi) a control system for (a) suspending operation of said slurry feed pump during a time period when slurry is not being supplied to said polishing table and said polishing table is performing a polishing operation, (b) suspending operation of said circulation system so as to stop slurry discharged from said preparation tank from being conveyed back into said preparation tank during a time period when the stock solution of slurry is not being diluted by the de-ionized water or chemical liquid, and (c) suspending the mixing of the stock solution of slurry with the de-ionized water or chemical solution during a time period when the stock solution of slurry is not being diluted by the de-ionized water or chemical liquid.

10. The polishing apparatus according to claim 9, wherein a portion of said slurry feed pipe is positioned within said slurry supply tank such that an inlet of said slurry feed pipe is spaced from a bottom of said slurry supply tank so as to prevent slurry agglomerate settled on the bottom of said slurry supply tank from entering into the inlet of said slurry feed pipe.

11. The polishing apparatus according to claim 10, further comprising:

another polishing table, wherein said slurry feeder further includes (i) another slurry feed pipe connected to said slurry supply tank, and (ii) another slurry feed pump for pumping slurry from said slurry supply tank to said another polishing table via said another slurry feed pipe.

12. A polishing apparatus comprising:

a polishing table; and a slurry feeder including (i) a slurry supply tank for holding slurry at a given concentration, (ii) a slurry feed pipe connected to said slurry supply tank, (iii) a slurry feed pump for pumping slurry from said slurry supply tank to said polishing table via said slurry feed pipe, and (iv) a control system for suspending operation of said slurry feed pump during a time period when slurry is not being supplied to said polishing table and said polishing table is performing a polishing operation, wherein a portion of said slurry feed pipe is positioned within said slurry supply tank such that an inlet of said slurry feed pipe is spaced from a bottom of said slurry supply tank so as to prevent slurry agglomerate settled on the bottom of said slurry supply tank from entering into the inlet of said slurry feed pipe.

13. A method of supplying a slurry to a polishing apparatus, comprising:

feeding, at a flow rate, from a slurry supply tank to a polishing apparatus a slurry including polishing particles, said polishing particles having a sedimentation velocity, wherein said flow rate is such that a flow velocity of said slurry in said slurry supply tank is greater than said sedimentation velocity.

* * * * *